United States Patent [19]

Hasegawa et al.

[11] Patent Number: 4,469,065

[45] Date of Patent: Sep. 4, 1984

[54] FUEL PUMP CONTROL SYSTEM FOR INTERNAL COMBUSTION ENGINES, HAVING A FAIL SAFE FUNCTION FOR ABNORMALITY IN FUEL INJECTION VALVES

[75] Inventors: Shumpei Hasegawa, Niiza; Shigeo Umesaki, Saitama, both of Japan

[73] Assignee: Honda Motor Co., Ltd., Tokyo, Japan

[21] Appl. No.: 521,237

[22] Filed: Aug. 8, 1983

[30] Foreign Application Priority Data

Aug. 17, 1982 [JP] Japan ..... 57-142382

[51] Int. Cl.[3] ..... F02D 1/12

[52] U.S. Cl. ..... 123/359; 123/198 D; 123/198 DB

[58] Field of Search ..... 123/479, 357, 358, 359, 123/198 DB, 198 D

[56] References Cited

U.S. PATENT DOCUMENTS 4,366,794 1/1983 Hachiga et al. ..... 123/479

4,383,511 5/1983 Jones ..... 123/359

FOREIGN PATENT DOCUMENTS 143141 9/1982 Japan ..... 123/359

*Primary Examiner*—Magdalen Y. C. Moy

*Attorney, Agent, or Firm*—Arthur L. Lessler

[57] ABSTRACT

A fuel pump control system for use in an internal combustion engine having fuel injection valves each disposed to be driven by a command signal indicative of a required quantity of fuel being supplied to the engine, corresponding to operating conditions of the engine, and a fuel pump for supplying pressurized fuel to the fuel injection valves, wherein the control system controls the operation of the fuel pump. The control system includes at least one abnormality determining means which is adapted to monitor the above command signal and a signal indicative of the operative state of a corresponding one of the fuel injection valves, and generate an abnormality-indicative signal after the levels of the two signals have become out of a predetermined logical relationship, whereby the fuel pump is rendered inoperative by the abnormality-indicative signal.

3 Claims, 4 Drawing Figures

FIG. 1B
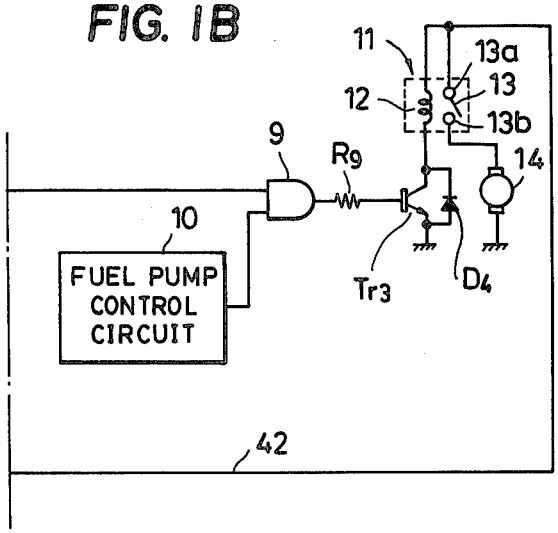
FIG. 1
| FIG. 1A | FIG. 1B |
|---|---|
FIG. 2
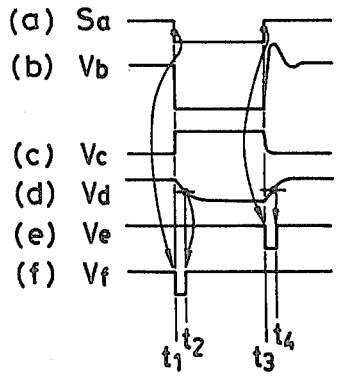

FUEL PUMP CONTROL SYSTEM FOR INTERNAL COMBUSTION ENGINES, HAVING A FAIL SAFE FUNCTION FOR ABNORMALITY IN FUEL INJECTION VALVES

BACKGROUND OF THE INVENTION

This invention relates to a system for controlling the operation of a fuel pump provided in internal combustion engines, and more particularly to a control system of this kind which is adapted to perform a fail safe function upon occurrence of an abnormality in any one of fuel injection valves which supply fuel through injection to the engine.

Conventional internal combustion engines of the fuel-injection type include a type which is equipped with an electronic fuel supply control system which operates to determine the quantity of fuel being supplied to the engine in accordance with operating conditions of the engine, and to electrically drive a fuel pump for pressure delivery of fuel from a fuel tank to fuel injection valves, while energizing the fuel injection valves with duty factors corresponding to the determined fuel quantity, in synchronism with generation of a signal indicative of predetermined crank angle positions of the engine.

In such internal combustion engines of the fuel-injection type, in the event that any one of the fuel injection valves becomes faulty so that it remains fully opened, it is necessary to interrupt the operation of the fuel pump to thereby prevent supply of an excessive amount of fuel to the engine as well as various undesirable results such as burning of a three-way catalyst arranged in the exhaust pipe of the engine for purifying exhaust gases, due to reaction with an excessive amount of unburned fuel.

SUMMARY OF THE INVENTION

It is the object of the invention to provide a fuel pump control system for an internal combustion engine, which is capable of positively detecting abnormalities in the fuel injection valves, and upon detecting such an abnormality, is adapted to prevent supply of an excessive amount of fuel to the engine, thereby avoiding various undesirable results such as burning of the three-way catalyst due to reaction with an wexcessive amount of unburned fuel.

According to the invention, there is provided a fuel pump control system for an internal combustion engine having fuel supply means for supplying fuel through injection to the engine, control means for determining the quantity of fuel being supplied to the engine in accordance with operating conditions of the engine and generating a command signal indicative of the determined fuel quantity, driving means responsive to the command signal for driving the fuel supply means, and fuel pump means for supplying pressurized fuel to the fuel supply means, wherein the fuel pump control system is adapted to control the operation of the fuel pump means. The fuel pump control system includes an abnormality determining means which comprises first monitoring means for monitoring the above command signal, second monitoring means for monitoring a signal indicative of the operative state of the fuel supply means, abnormality detecting means adapted to generate an abnormality-indicative signal after the level of the command signal and the level of the signal indicative of the operative state of the fuel supply means have become out of a predetermined logical relationship, and stopping means responsive to the abnormality-indicative signal for rendering the fuel pump means inoperative.

The fuel pump control system according to the invention may also be applied to an internal combustion engine having a plurality of cylinders and a plurality of fuel supply means corresponding, respectively, to the cylinders, wherein the fuel pump control system includes a plurality of the aforementioned abnormality determining means. In each of the abnormality determining means, the stopping means is responsive to the above abnormality-indicative signal from the abnormality detecting means of the same abnormality determining means, for rendering the fuel pump means inoperative.

The above and other objects, features and advantages of the invention will be more apparent from the ensuing detailed description taken in conjunction with the accompanying drawings.

BRIEF DESCRIPTION OF THE DRAWINGS

FIG. 2 is a timing chart showing changes in the levels of signals generated at various points of the circuit of FIG. 1, plotted with respect to the progress of time.

DETAILED DESCRIPTION

The invention will now be described in detail with reference to the drawings showing an embodiment of the invention.

Figure 1A:
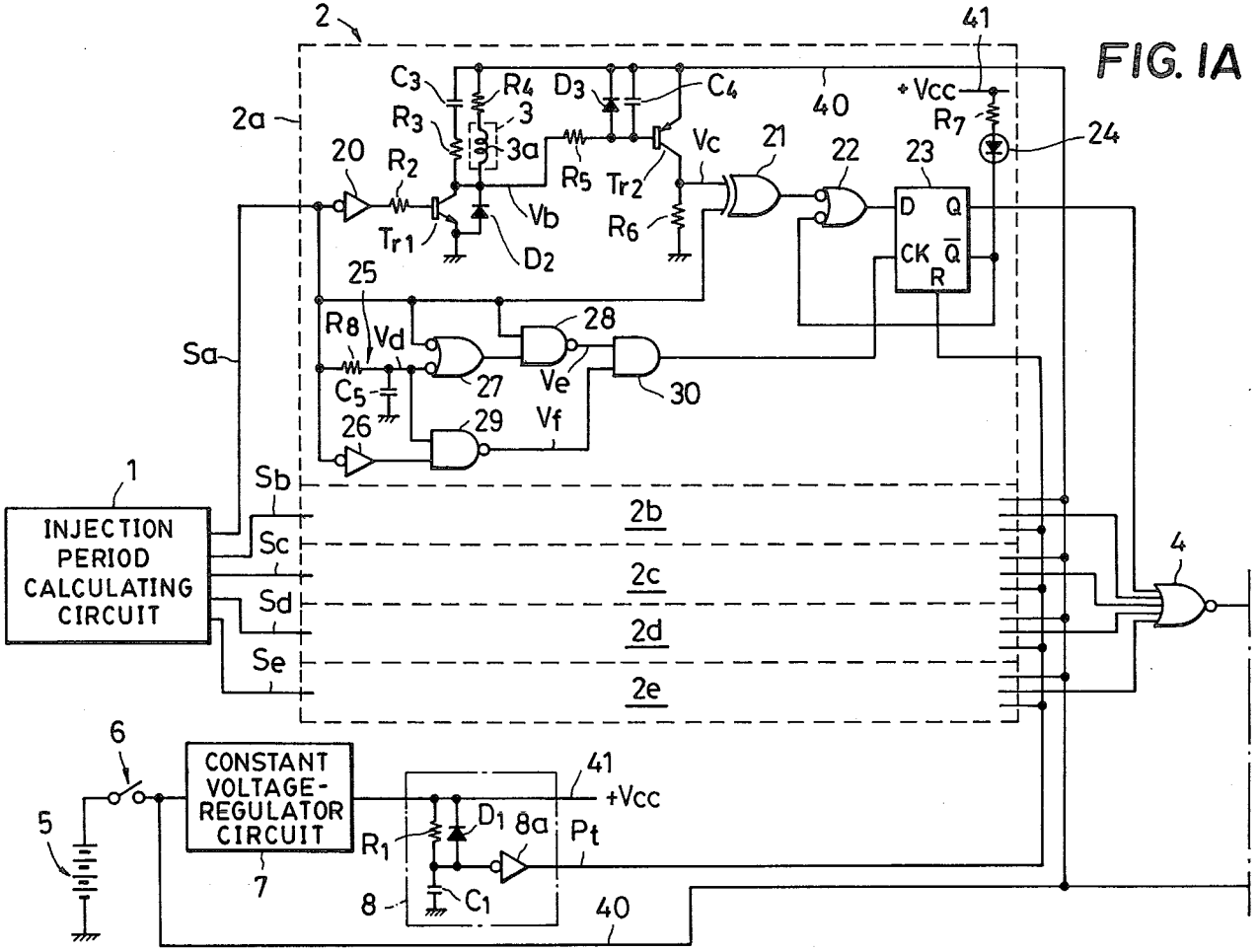
FIG. 1 (FIG. 1A and FIG. 1B) is a circuit diagram showing the internal arrangement of a fuel pump control system according to the invention, particularly showing details of a section for detection of abnormalities in the fuel injection valves.

Referring to FIG. 1, there is illustrated in the form of a block diagram a fuel pump control system according to the invention, which is applied to an electronic fuel supply control system for an internal combustion engine having a plurality of cylinders each provided with a main combustion chamber and a sub combustion chamber. In the figure, reference numeral 1 designates an injection period calculating circuit which is arranged within an electronic fuel control unit for control of the fuel supply to the engine, and is adapted to calculate values of the fuel injection period Ti through which fuel is to be injected into the engine, in response to values of engine operation parameters such as engine rotational speed, intake pipe absolute pressure and throttle valve opening, detected, respectively, by an engine rotational speed sensor, an intake pipe absolute pressure sensor and a throttle valve opening sensor, none of which are shown. The injection period calculating circuit 1 successively generates command signals Sa–Sd for energizing main injection valves 3 which are disposed to supply fuel into respective ones of the main combustion chambers, and only one of which is shown, and a sub injection valve, not shown, which is disposed to supply fuel into all the sub combustion chambers, for periods of time corresponding to the calculated values of the injection period Ti, in predetermined sequence determined by pulses of a crank angle position signal, each indicative of a predetermined crank angle position of the engine and generated by the above engine rotational speed sensor each time the crankshaft of the engine rotates through 180 degrees, as well as by pulses of a cylinder-discriminating signal generated by a cylinder-discriminating sensor, not shown, at a predetermined crank angle position of a piston within a particular cylinder of the engine. These command signals Sa–Sd and Se are supplied, respectively, to main injection valve abnormality-detecting circuits 2a–2d and a sub injection valve abnormality-detecting circuit 2e.

In the main injection valve abnormality-detecting circuit 2a for instance, the command signal Sa is applied to an integrating circuit 25 which is formed of inverters 20 and 26, an exclusive OR circuit 21, NAND circuits 27 and 28, a resistance R8 and a capacitor C5. The output of the inverter 20 is connected by way of a resistance R2 to the base of a transistor Tr1 which has its emitted grounded. Connected between the collector of the transistor Tr1 and a conductor 40 are a series circuit formed of a resistance R3 and a capacitor C3 and another series circuit formed of a solenoid 3a of a corresponding one of the main injection valves 3 and a resistance R4. A diode D2 is connected between the collector of the transistor Tr1 and the emitter of same. The collector of the transistor Tr1 is connected to the base of another transistor Tr2 by way of a resistance R5. A diode D3 and a capacitor C4 are connected in parallel between the junction of the resistance R5 with the base of the transistor Tr2 and the conductor 40. The transistor Tr2 has its emitter connected to the above conductor 40 and its collector grounded by way of a resistance R6 and also connected to the input of the exclusive OR circuit 21. The output of the exclusive OR circuit 21 is connected to the input of a NAND circuit 22 which in turn has its output connected to an input terminal D of a D-flip flop 23.

The junction of the resistance R8 of the integrating circuit 25 with the capacitor C5 of same is connected to the input of the NAND circuit 27 as well as to the input of a NAND circuit 29. The output of the NAND circuit 27 is connected to the input of the NAND circuit 28. The output of the inverter 26 is connected to the output of the NAND circuit 29. The outputs of the NAND circuits 28, 29 are connected to the input of an AND circuit 30 which has its output connected to an input terminal CK of the D-flip flop 23.

On the other hand, a battery 5 is connected by way of an ignition switch 6 of the engine to a constant voltage-regulator circuit 7 as well as to the conductor 40. Thus, the constant voltage-regulator circuit 7 generates an output voltage +Vcc having a predetermined level through a conductor 41 when the ignition switch 6 is turned on or closed. Connected to the output of the constant voltage-regulator circuit 7 is a trigger pulse generator circuit 8 which is formed of a series circuit of a resistance R1 and a capacitor C1, a diode D1 connected in parallel with the resistance R1, and a Schmitt trigger circuit 8a connected to the junction of the capacitor C1 with the resistance R1. Thus, the trigger pulse generator circuit 8 generates a trigger pulse Pt upon application of the output voltage +Vcc thereto from the constant voltage-regulator circuit 7, that is, upon turning-on or closing of the ignition switch 6.

The D-flip flop 23 has an output terminal Q connected to the input of a NOR circuit 4 and another output terminal $\overline{Q}$ connected to the conductor 41 by way of a light emission diode 24 as an alarm device and a resistance R7, and directly connected to the input of the NAND circuit 22. The D-flip flop 23 is adapted to generate a low level output (hereinafter called "0") at its output terminal Q and a high level output (hereinafter called "1") at its other output terminal $\overline{Q}$, when it is in a reset state, and when it is set by application of an input to its input terminal D at a high level (hereinafter called "1"), the outputs at the output terminals Q and $\overline{Q}$ are inverted into 1 and 0, respectively.

The other main injection valve abnormality-detecting circuits 2b–2d and the sub injection valve abnormalty-detecting circuit 2e have similar arrangements to that of the main injection valve abnormality-detecting circuit 2a described above, description of which is therefore omitted. The output terminals Q of the D-flip flops, not shown, of these abnormality-detecting circuits 2b–2e are connected to the input of the NOR circuit 4. The output of the NOR circuit 4 is connected to the input of the AND circuit 9 to which is also connected the output of a fuel pump control circuit 10. The output of the AND circuit 9 is connected to the base of a transistor Tr3 which has its emitter grounded and its collector connected to the conductor 40 by way of a coil 12 of a relay circuit 11 and another conductor 42, with a diode D4 connected between the collector and the emitter. The relay circuit 11 has a contact 13 which has one connecting terminal 13a connected to the conductor 42 and the other connecting terminal 13b to a fuel pump 14, respectively.

With the above arrangement, when the ignition switch 6 of the engine is turned on to start the engine, the conductors 40, 42 are supplied with an output voltage from the battery 5, and accordingly the conductor 41 is supplied with the regulated voltage +Vcc from the constant voltage-regulator circuit 7. On this occasion, the trigger pulse generator circuit 8 generates a trigger pulse Pt and applies same to a reset pulse input terminal R of the D-flip flop 23 to reset the same flip flop 23 so that the outputs at the output terminals Q, $\overline{Q}$ become 0 and 1, respectively. This causes energization of the AND circuit 9 to transfer a control signal from the fuel pump control circuit 10 to the transistor Tr3 to energize same. Upon energization of the transistor Tr3, the coil 12 is energized to cause the contact 13 to be closed. Then, the fuel pump 14 starts to operate for pressure delivery of fuel from a fuel tank, not shown, to the fuel injection valves 3.

On the other hand, the injection period calculating circuit 1 calculates values of the injection period Ti corresponding to operating conditions of the engine and generates command signals Sa–Se as previously described. When the command signal Sa assumes 1 as shown at (a) in FIG. 2, the transistor Tr1 becomes cut off to deenergize the solenoid 3a of the fuel injection valve 3 whereby the fuel injection valve 3 is closed, that is, no fuel injection is effected. On this occasion, the collector voltage Vb of the transistor Tr1 assumes 1 ((b) in FIG. 2), and accordingly the transistor Tr2 is cut off with its collector voltage Vc at 0 ((c) in FIG. 2), thus causing the exclusive OR circuit 21 to generate an output of 1. Therefore, the two inputs to the NAND circuit 22 become both 1 so that the output of the same circuit 22 becomes 0, holding the D-flip flop 22 in a reset state. The collector voltage Vc of the transistor Tr2 can be taken as a signal indicative of the operative state of the fuel injection valve 3, and therefore the signal Vc is hereinafter called "the operative state signal". When the command signal Sa has a value of 1, the output Vd from the integrating circuit 25 has a level of 1 ((d) in FIG. 2), and accordingly the outputs Ve, Vf from the NAND circuits 28, 29 both have a level of 1 ((e), (f) in FIG. 2) so that the output from the AND circuit 30 has a level of 1.

Assuming now that the level of the command signal Sa changes from 1 to 0 at a moment t1 as shown at (a) in FIG. 2, the transistor Tr1 conducts to energize the solenoid 3a of the fuel injection valve 3 to open the same valve. At the same time, the voltage level Vb at the collector of the same transistor drops to 0 ((b) in FIG. 2), causing the transistor Tr2 to conduct so that the level of the operative state signal Vc becomes 1, as shown at (c) in FIG. 2. Thus, the output from the exclusive OR circuit 21 becomes 1. On the other hand, when the level of the command signal Sa drops to 0, the capacitor C5 of the integrating circuit 25 starts to be discharged at the time t1 so that its terminal voltage Vd gradually drops, as shown at (d) in FIG. 2. At the time t1, the output Vf from the NAND circuit 29 drops to 0 as at (f) in FIG. 2, but it recovers a level of 1 at a time t2 when the output voltage Vd from the integrating circuit 25 drops to a predetermined level. This change in the output Vf from the NAND circuit 29 causes the AND circuit 30 to generate an output pulse. The D-flip flop 23 is loaded with an input through its input terminal D when the output voltage Vf from the NAND circuit 29 changes from 0 to 1. However, on this occasion, the input through the input terminal D has a level of 0 so that the D-flip flop 23 is not reset by the above input but it remains in a reset state with its output through the output terminal Q held at a level of 0, thereby allowing the fuel pump 14 to continue to operate.

At a time t3 when the level of the command signal Sa changes from 0 to 1 as at (a) in FIG. 2, the transistors Tr1, Tr2 both become cut off, whereby the solenoid 3a of the fuel injection valve 3 becomes deenergized to close the same valve, while simultaneously the output from the transistor Tr2, that is, the level of the operative state signal Vc becomes 0 ((c) in FIG. 2). Even at this time, the output from the exclusive OR circuit 21 remains at a level of 0 and accordingly the output from the NAND circuit 22 remains at a level of 0 so that the D-flip flop 23 remains in a reset state. Incidentally, when the transistor Tr1 becomes cut off, the electromagnetic energy generated by the solenoid 3a is consumed by a resonance circuit formed by the solenoid 3a, the resistance R3, the capacitor C3, and the resistance R4 to thereby impede generation of a large counter electromotive voltage from the solenoid 3a and protect the transistor Tr1 from being damaged by the counter electromotive voltage.

Starting from the time t3 when the level of the command signal Sa becomes 1, the output voltage Vd of the integrating circuit 25 gradually increases as shown at (d) in FIG. 2, while on the other hand the output Ve from the NAND circuit 28 becomes 0 at the time t3 when the level of the command signal Sa becomes 1, and becomes 1 at a time t4 when the output voltage Vd from the integrating circuit 25 reaches a predetermined level, as shown at (e) in FIG. 2. In the same manner as previously stated, the D-flip flop 23 is loaded with an input through its input terminal D when the voltage Ve applied thereto through the AND circuit 30 rises to a level of 1 at the time t4, and at this moment the above input has a level of 0 so that the D-flip flop 23 is not set but remains in a reset state in the same manner as previously stated, allowing the fuel pump 14 to continue to operate.

In this way, so long as the fuel injection valve 3 is normally operating, the level of the command signal Sa and the level of the operative state signal Vc are always inverted with respect to each other, as shown at (a), (c) in FIG. 2, whereby the D-flip flop 23 is kept in a reset state, allowing the fuel pump 14 to continue operating.

Let it now be assumed that there occurs grounding of a portion of the solenoid 3a on the side of the transistor Tr1 or a short between the collector of the transistor Tr1 and the emitter of same, for some cause, the transistor Tr1 becomes cut off irrespective of the level of the input thereto so that the collector voltage Vb becomes 0. Consequently, the transistor Tr2 conducts so that the level of the operative state signal Vc becomes 1 and is held at this high level thereafter. In this state, if the level of the command signal Sa changes from 0 to 1, the output from the exclusive OR circuit 21 becomes 0 so that the outut from the NAND circuit 22 becomes 1. At the same time, the change of the level of the command signal Sa causes a drop in the level of the output voltage Ve from the NAND circuit 28 as at (e) in FIG. 2. When the leading edge of the pulse Ve is applied to the clock input terminal CK, the D-flip flop 23 is set or is loaded with the output of 1 from the NAND circuit 22, to generate an output of 1 through its output terminal Q, which deenergizes the AND circuit 9 so that the transistor Tr3 becomes cut off, thereby interrupting the operation of the fuel pump 14. At the same time, the output at the output terminal $\overline{Q}$ of the D-flip flop 23 becomes 0, energizing the light emission diode 24. The same output at the output terminal $\overline{Q}$ is applied to the NAND circuit 22. Then, when the level of the command signal Sa changes from 1 to 0, the output from the exclusive OR circuit 21 becomes 1, but the output from the NAND circuit 22 remains 1 because it is then supplied at its one input with the output of 0 from the output terminal $\overline{Q}$ of the D-flip flop 23. Therefore, even when the leading edge of the immediately following pulse of the output signal Vf from the NAND circuit 29 ((f) in FIG. 2) is applied to the clock input terminal CK, the D-flip flop 23 remains in a set state. In this way, in the event that there occurs the aforementioned grounding or short, once the level of the command signal Sa has changed from 0 to 1 immediately after occurrence of the disconnection of the solenoid 3a, the output from the NAND circuit 22 changes to 1 and is thereafter held at this high level. Thereafter, irrespective of changes in the levels of the voltages Vf, Ve applied to the input terminal CK, the D-flip flop 23 remains in a set state, thereby keeping the fuel pump 14 inoperative for suspension of the fuel supply.

Further, let it also be assumed that there occurs disconnection of a lead wire connecting between the emitter of the transistor Tr1 and the ground, or opening between the collector of the transistor Tr1 and the emitter of same, for some cause, no collector current occurs irrespective of the level of the input to the transistor Tr1 so that the transistor Tr2 becomes cut off and accordingly the level of the operative state signal Vc becomes 0 and is held at this low level thereafter. In this state, if the level of the command signal Sa changes from 1 to 0, the output from the exclusive OR circuit 21 becomes 0 so that the outut from the NAND circuit 22 becomes 1. At the same time, the change of the level of the command signal Sa causes a drop in the level of the output voltage Vf from the NAND circuit 28 as at (f) in FIG. 2. When the leading edge of the pulse Ve is applied to the clock input terminal CK, the D-flip flop 23 is set or is loaded with the output of 1 from the NAND circuit 22, to generate an output of 1 through its output terminal Q, which deenergizes the AND circuit 9 so that the transistor Tr3 becomes cut off, thereby interrupting the operation of the fuel pump 14. At the same time, the output at the output terminal $\overline{Q}$ of the D-flip flop 23 becomes 0, energizing the light emission diode 24. The same output at the output terminal $\overline{Q}$ is applied to the NAND circuit 22. Then, when the level of the command signal Sa changes from 0 to 1, the output from the exclusive OR circuit 21 becomes 1, but the output from the NAND circuit 22 remains 1 because it is then supplied at its one input with the output of 0 from the output terminal $\overline{Q}$ of the D-flip flop 23. Therefore, even when the leading edge of the immediately following pulse of the output signal Ve from the NAND circuit 29 ((e) in FIG. 2) is applied to the clock input terminal CK, the D-flip flop 23 remains in a set state. In this way, in the event that there occurs the aforementioned disconnection or opening, once the level of the command signal Sa has changed from 1 to 0 immediately after occurrence of the disconnection of the solenoid 3*a*, the output from the NAND circuit 22 changes to 1 and is thereafter held at this high level. Thereafter, irrespective of changes in the levels of the voltages Vf, Ve applied to the input terminal CK, the D-flip flop 23 remains in a set state, thereby keeping the fuel pump 14 inoperative for suspension of the fuel supply.

The same manner of operation of the abnormality determining circuit 2*a* described above applies to the other abnormality determining circuits 2*b*–2*e*. Therefore, if any one of the fuel injection valves becomes faulty, the fuel pump is automatically rendered inoperative, while simultaneously giving warning by means of energization of the light emission diode 24.

Figure 3:
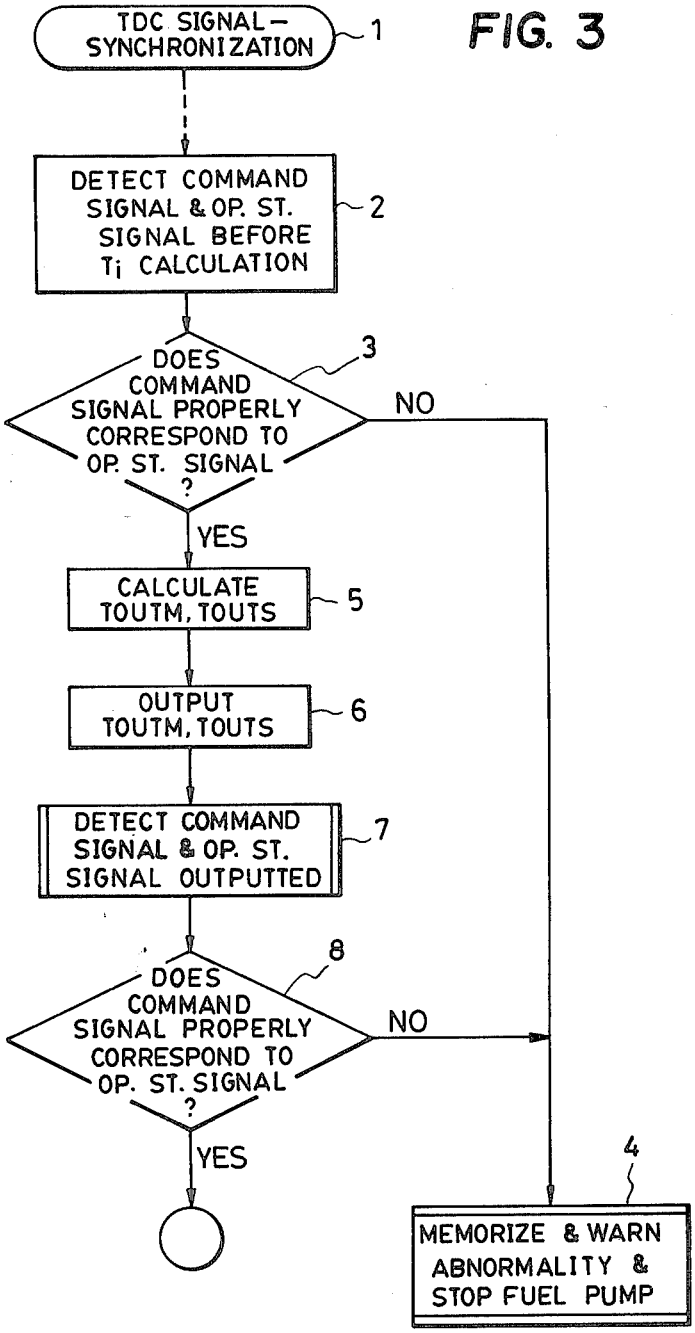
FIG. 3 is a flow chart showing the operation of the abnormality detecting section of the circuit of FIG. 1.

FIG. 3 is a flow chart showing the operation of the abnormality detecting section of the circuit of FIG. 1. The timing of fuel injections into individual ones of the main injection valves 3 and the sub injection valve is determined in accordance with generation of the crank angle position signal (TDC signal), at the step 1. Then, at the step 2, detection is made of the value of one of the command signals Sa–Sd to be applied to one of the main injection valves 3 which is to be actuated for fuel injection in synchronism with the present pulse of the TDC signal in accordance with the injection timing determined at the step 1, and the value of the command signal Se to be applied to the sub injection valve which is to be actuated for fuel injection in synchronism with each pulse of the TDC signal, as well as the values of the operative state signals corresponding, respectively, to these injection valves. The above detection is made immediately before completion of calculations of the fuel injection periods Ti for these injection valves. That is, the above command signals then have a value of 1 to command deenergization of the respective injection valves, while the operative state signals VC should have a value of 0 indicative of deenergization of the corresponding injection valves so long as these valves are normally operating. Then, it is determined at the step 3 whether or not the above operative state signals each have a value properly corresponding to the value of its corresponding command signal, that is, a value of 0 indicative of deenergization of its corresponding injection valve. If the answer to the question of the step 3 is negative or no, that is, if either of the operative state signals shows a value of 1, it is judged that there is an abnormality in the injection valve concerned, and then the occurrence of such abnormality is memorized, warning is given by the light emission diode 24, and the fuel pump 14 is stopped, at the step 4. If the answer to the question of the step 3 is affirmative or yes, the valve opening periods TOUTM and TOUTS for the above main injection valve corresponding to the present pulse of the TDC signal and the sub injection valve are calculated by the injection period calculating circuit 1, at the step 5, and the command signals having a value of 0 and indicative of the calculated valve opening periods TOUTM, TOUTS are outputted from the circuit 1, at the step 6. Thereafter, detection is made of the values of the command signals outputted above as well as the values of their corresponding operative state signals, at the step 7. At the step 8, it is determined whether or not each of these operative state signals shows a value properly corresponding to its corresponding outputted command signal, that is, a value of 1 indicative of energization of the injection valve concerned. If the answer is negative or no, it is judged that there is an abnormality in the same injection valve, and the program proceeds to the step 4 to perform the aforementioned actions. If the answer is yes, the execution of the present loop of the abnormality detection operation is terminated on the assumption that there is no abormality in either of the injection valves.

What is claimed is:

1. A fuel pump control system for use in an internal combustion engine having fuel supply means for supplying fuel through injection to said engine, control means for determining the quantity of fuel being supplied to said engine in accordance with operating conditions of said engine and generating a command signal indicative of the determined fuel quantity, driving means responsive to said command signal for driving said fuel supply means, and fuel pump means for supplying pressurized fuel to said fuel supply means, wherein said fuel pump control system is adapted to control the operation of said fuel pump means, said fuel pump control system including an abnormality determining means comprising: first monitoring means for monitoring said command signal, second monitoring means for monitoring a signal indicative of the operative state of said fuel supply means, abnormality detecting means adapted to generate an abnormality-indicative signal after the level of said command signal and the level of said signal indicative of the operative state of said fuel supply means have become out of a predetermined logical relationship, and stopping means responsive to said abnormality-indicative signal for rendering said fuel pump means inoperative.

2. A fuel pump control system as claimed in claim 1, further including indicating means responsive to said abnormality-indicative signal for indicating the occurrence of an abnormality in said fuel supply means.

3. A fuel pump control system for use in an internal combustion engine having a plurality of cylinders, a plurality of fuel supply means for supplying fuel through injection to respective ones of said cylinders, control means for determining the quantity of fuel being supplied to each of said cylinders in accordance with operating conditions of said engine and generating a plurality of command signals, each indicative of the determined fuel quantity being supplied to a corresponding one of said cylinders, driving means responsive to said command signals for driving said fuel supply means, and fuel pump means for supplying pressurized fuel to said fuel supply means, wherein said fuel pump control system is adapted to control the operation of said fuel pump means, said fuel pump control system including a plurality of abnormality determining means each comprising: first monitoring means for monitoring a corresponding one of said command signals, second monitoring means for monitoring a signal indicative of the operative state of a corresponding one of said fuel supply means, abnormality detecting means adapted to generate an abnormality-indicative signal after the level of said corresponding one of said command signals and the level of said signal indicative of the operative state of said corresponding one of said fuel supply means have become out of a predetermined logical relationship, and stopping means responsive to said abnormality-indicative signal for rendering said fuel pump means inoperative.

* * * * *